United States Patent [19]

Williams, Jr.

[11] 4,253,416

[45] Mar. 3, 1981

[54] METERED FINISH

[75] Inventor: Louis B. Williams, Jr., Walnut Hill, Fla.

[73] Assignee: Monsanto Company, St. Louis, Mo.

[21] Appl. No.: 54,385

[22] Filed: Jul. 2, 1979

[51] Int. Cl.[3] ..... B05C 3/00

[52] U.S. Cl. ..... 118/401; 118/411; 118/412; 118/420

[58] Field of Search ..... 427/445; 118/420, 411, 118/412, 401, DIG. 19; 8/151.2, 158

[56] References Cited

U.S. PATENT DOCUMENTS

| | | | |
|---|---|---|---|
| 3,998,183 | 12/1976 | Kane | 118/420 |
| 4,063,531 | 12/1977 | Zitzow | 118/411 |

*Primary Examiner*—Ronald H. Smith
*Assistant Examiner*—Janyce A. Bell
*Attorney, Agent, or Firm*—Kelly O. Corley

[57] ABSTRACT

In application of metered finish to a high speed running yarn, a check valve at the end of the finish passageway prevents entrained air fluctuations from entering the finish passageway.

6 Claims, 5 Drawing Figures

METERED FINISH

The invention relates to the art of metering finish onto a yarn running at high speed.

An essential part of spinning a man-made yarn is application to the yarn of a finish, which is a liquid composition for lubrication, reduction of static electricity, and other functions. Non-uniform application of the finish along the length of the yarn creates various processing problems in subsequent operations on the yarn, and causes defects in products made from the yarn. Finish has commonly been applied by contacting the running yarn with the periphery of a slowly rotating wheel, the lower portion of the wheel being immersed in the finish. This method gives somewhat erratic results.

More recently, attempts have been made to meter the finish to an applicator (commonly known as a "finish pin") in order to improve uniformity of finish application. However when yarn speeds are above 2500 meters per minute, erratic results are frequently obtained when using known commercially available applicators. Applicant has discovered that much of the difficulty arises because of the influence of the turbulent, high speed air entrained with the rapidly moving yarn.

According to a primary aspect of the invention there is provided, in a finish applicator wherein finish is metered through a passageway to a yarn running at least 2500 meters per minute, the improvement comprising check valve means at the exit end of the passageway for permitting the finish to exit from the passageway while substantially preventing stray air currents from entering the exit end. According to a further aspect of the invention, finish exiting past the check valve means flows downwardly in a groove prior to contacting the yarn. According to a further aspect of the invention, the check valve means comprises a flap extending across the exit end. According to a further aspect of the invention, the flap is normally resiliently biased toward the exit end.

Other aspects will in part appear hereinafter and will in part be obvious from the following detailed disclosure taken in connection with the accompanying drawings, wherein.

Figure 1:
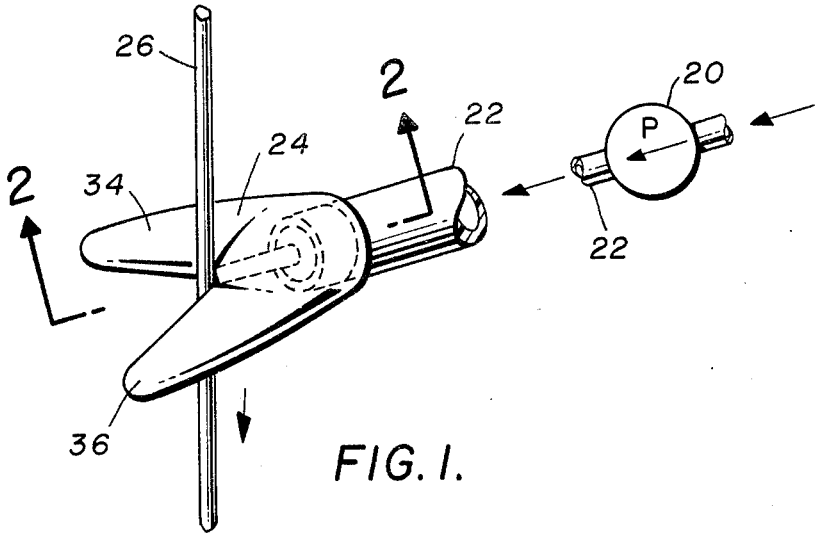
FIG. 1 is a schematic perspective view of a finish metering system.

FIG. 1 schematically shows the general metered finish system. As illustrated, finish is metered at a selected constant rate by metering pump 20 through line 22 to metering pin 24 for application to running yarn 26.

Figure 2:
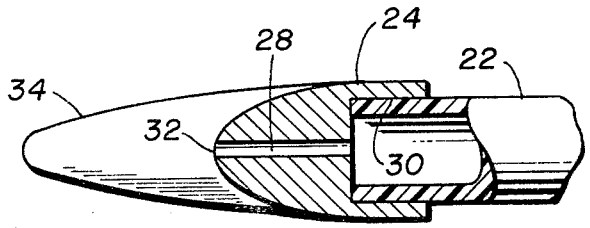
FIG. 2. (PRIOR ART)
FIG. 2 is a sectional view taken along line 2—2 in FIG. 1 showing a generalized prior art finish pin.
Figure 3:
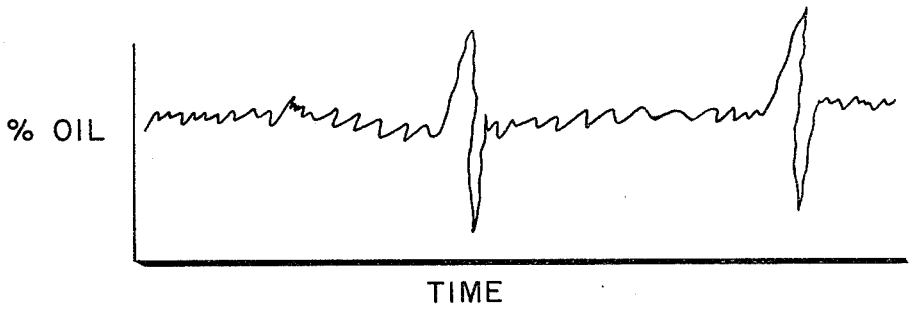
FIG. 3 is a generalized graph showing one type of observed concentration of finish applied on yarn with the FIG. 2 type of finish pin.

When finish pin 24 is constructed according to the prior art, as exemplified by FIG. 2, erratic results are frequently obtained, particularly when yarn 26 is moving at least 2500 meters per minute. In the FIG. 2 construction, a simple right circularly cylindrical fluid passageway 28 extends from the supply end 30 for receiving line 22 to its exit end 32, the latter lying at the bottom of a groove formed between two protruding fingers 34 and 36. Yarn 26 rides in the groove to receive the finish metered through passageway 28. Depending on the diameter of passageway 28, the rate at which pump 20 supplies finish, the speed of yarn 26 and the orientation of yarn 26 with respect to finish pin 24, the resulting concentration of finish on yarn 26 is frequently observed to be erratic rather than substantially constant as is desired. One such pattern is schematically shown in FIG. 3, which is a simplified or stylized representation of charts made using a denier monitoring instrument model M/7000R commercially available from Micro Sensors, Inc., together with head model 708 HC for this instrument from the same manufacturer. The output of this instrument responds not only to yarn denier but also to concentration of finish on yarn. The particular phenomena depicted in FIG. 3 is a normally reasonably constant finish level (fluctuations within a narrow range) followed first by an abrupt increase in finish level well outside the narrow range, then by a sharp decrease to an abnormally low level outside the normal range, then a return to the narrow range. A second such sequence is also shown. Other patterns of deviation from the normal narrow range may be generated, depending on the factors noted above.

It has been discovered that such undesirable deviations may be substantially reduced by providing check valve means at the exit end of the passageway for permitting the finish to exit from the passageway while substantially preventing stray air currents from entering the exit end. The entrained air is highly turbulent and apparently frequently enters exit end 32 of passageway 28, displacing a quantity of finish before it would normally have left the passageway exit under the urging of pump 20. This would account for the observed abrupt increases in finish level (FIG. 3). Since such action would deplete the finish in exit end 32, a lower than normal quantity of finish would then be applied to yarn 26 until passageway 28 were again filled with finish by pump 20, thus accounting for the abnormally low levels of finish depicted in FIG. 3. However, regardless of the specific mechanism, addition of a check valve as described below has been found to substantially reduce the undesired fluctuations in level of finish applied to yarn 26.

Figure 4:
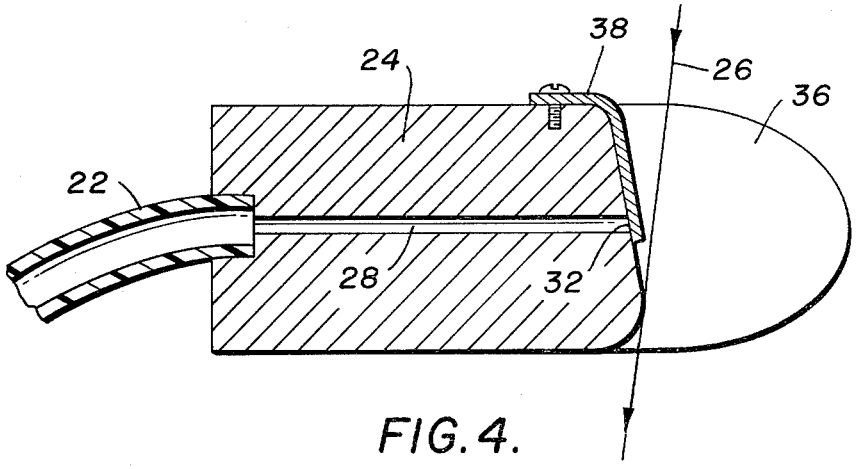
FIG. 4 is a sectional view (similar to FIG. 2) of the preferred embodiment of a finish pin according to the invention.
Figure 5:
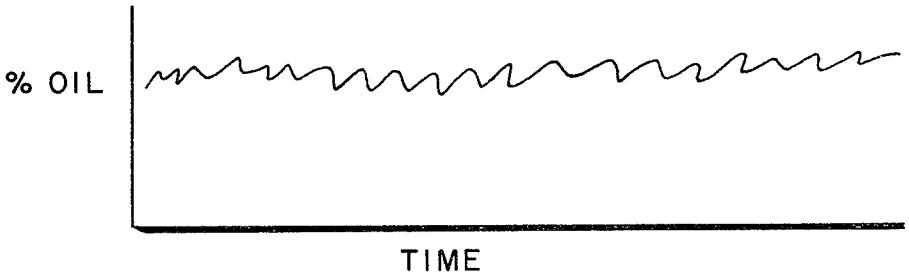
FIG. 5 is a generalized graph of concentration of finish applied on yarn with the FIG. 4 finish pin.

The preferred embodiment of the invention is shown in FIG. 4, wherein check valve means 38 covers exit end 32 of passageway 28. The illustrated check valve is in the form of a narrow flap or flat spring lying in the groove, the flap being attached at its upper end to pin 24 and resiliently biased toward exit end 32. Pressurized finish from passageway 28 forces its way past check valve 38, then flows downwardly in the groove formed between the fingers before contacting yarn 26. Valve 38 prevents the turbulent air entrained with yarn 26 from affecting finish being metered through passageway 28, thus reducing substantially or eliminating the undesirable large fluctuations in finish levels shown in FIG. 3 to the desirable levels shown in FIG. 5.

What is claimed is:

1. In a finish applicator wherein finish is metered through a passageway to a yarn, the improvement comprising check valve means at the exit end of said passageway for permitting said finish to exit from said passageway while substantially preventing stray air currents from entering said exit end.

2. The finish applicator defined in claim 1, wherein finish exiting past said check valve means flows downwardly in a groove prior to contacting said yarn.

3. The finish applicator defined in claim 1, wherein said check valve means comprises a flap extending across said exit end.

4. The finish applicator defined in claim 3, wherein said flap is normally resiliently biased toward said exit end.

5. The finish applicator defined in claim 2, wherein said check valve means comprises a flap extending across said exit end.

6. The finish applicator defined in claim 5, wherein said flap is normally resiliently biased toward said exit end.

* * * * *